US006773356B2

(12) United States Patent
Odom

(10) Patent No.: US 6,773,356 B2
(45) Date of Patent: Aug. 10, 2004

(54) GOLF SWING PRACTICE APPARATUS AND ASSOCIATED METHOD

(76) Inventor: Ray D. Odom, 853 Champions Dr. NE., Palm Bay, FL (US) 32905

( * ) Notice: Subject to any disclaimer, the term of this patent is extended or adjusted under 35 U.S.C. 154(b) by 26 days.

(21) Appl. No.: 09/982,256

(22) Filed: Oct. 18, 2001

(65) Prior Publication Data

US 2003/0078110 A1 Apr. 24, 2003

(51) Int. Cl.[7] ..... A63B 61/36

(52) U.S. Cl. ..... 473/150; 473/278; 473/280; 473/219

(58) Field of Search ..... 473/150–156, 473/278, 279, 280, 219; 354/856

(56) References Cited

U.S. PATENT DOCUMENTS

| | | | | |
|---|---|---|---|---|
| 2,879,996 A | * | 3/1959 | Lederer | 473/279 |
| 3,647,284 A | * | 3/1972 | Elings et al. | 359/858 |
| 4,254,956 A | * | 3/1981 | Rusnak | 473/225 |
| 4,858,934 A | | 8/1989 | Ladick et al. | |
| 5,297,796 A | | 3/1994 | Peterson | |
| 5,433,446 A | | 7/1995 | Lindstedt, Jr. | |
| 5,437,457 A | * | 8/1995 | Curchod | 473/199 |
| 5,826,874 A | | 10/1998 | Teitell et al. | |
| 5,833,549 A | | 11/1998 | Zur et al. | |
| 6,199,861 B1 | | 3/2001 | Hume et al. | |
| 6,254,492 B1 | | 7/2001 | Taggett | |
| 6,312,345 B1 | * | 11/2001 | Pelz | 473/278 |

* cited by examiner

*Primary Examiner*—Mark S. Graham

(57) ABSTRACT

A golf swing practice apparatus comprises a playing surface for a golfer to thereon practice a swing, and a reflector positioned adjacent the playing surface, the reflector comprising a curved reflecting surface adapted for focusing a reflection of a golf ball so as to produce an image of the golf ball appearing adjacent the playing surface for a golfer to swing a golf club therethrough. An associated method of the invention comprises reflecting the image of a golf ball from a curved reflecting surface to form an image of the golf ball adjacent the reflecting surface, and swinging a golf club through the image of the golf ball to thereby practice the golf swing.

30 Claims, 4 Drawing Sheets

GOLF SWING PRACTICE APPARATUS AND ASSOCIATED METHOD

FIELD OF THE INVENTION

The present invention relates to the field of golf and, more particularly, to a golf swing practice apparatus producing the image of a golf ball to simulate an actual ball.

BACKGROUND OF THE INVENTION

Those who have tried the game of golf appreciate the fact that the game presents a challenge to even experienced players attempting to perfect an effective golf swing. Practice of the golf swing is a task which both experienced and novice players must continually perform in their search for improvement. Such golf practice typically requires use of a golf practice range, and a large number of golf balls. Of course, a golfer may practice swinging a golf club without using a ball, but this does not produce the same effect as if there were a ball set upon a tee for the golfer to hit. In addition, it would be of great advantage if there were an easily portable device which would allow a golfer to practice the golf swing within a restricted space, and with a golf ball positioned ready to be hit as an aid in improving the golfer's address of the ball and golf swing.

SUMMARY OF THE INVENTION

With the foregoing in mind, the present invention advantageously provides a golf swing practice apparatus which requires no golf balls and, accordingly, may be used inside a home or office, and is portable so that the golfer may take the apparatus to the golf course, or practice range to use in warm-up practice.

The golf swing practice apparatus comprises a playing surface for a golfer to thereon practice a swing, and a reflector positioned adjacent the playing surface, the reflector having a curved reflecting surface adapted for focusing a reflection of a golf ball so as to produce an image of the golf ball appearing on the playing surface for the golfer to swing therethrough.

The golf swing practice apparatus preferably includes a support for supporting the playing surface. In this embodiment, the reflector is positioned in the support underlying the playing surface, the reflector having a curved reflecting surface adapted for focusing a reflection of a golf ball so as to produce an image of the golf ball appearing adjacent the playing surface, the image serving for a golfer to swing a golf club therethrough. A further embodiment of the invention includes a housing storing the playing surface, support and reflector so as to make the golf swing practice apparatus portable. The housing itself may provide sufficient support so as to render unnecessary a separate support frame, so that the housing itself constitutes the support.

A method associated with the invention includes practicing a golf swing by reflecting the image of a golf ball from a curved reflecting surface to form an image of the golf ball appearing adjacent the reflecting surface, and swinging a golf club through the image of the golf ball.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

In a preferred embodiment the present invention employs reflector technology described in U.S. Pat. No. 3,647,284 issued to Elings et al. on Mar. 7, 1972, said patent being incorporated herein by reference in its entirety.

Figure 2:
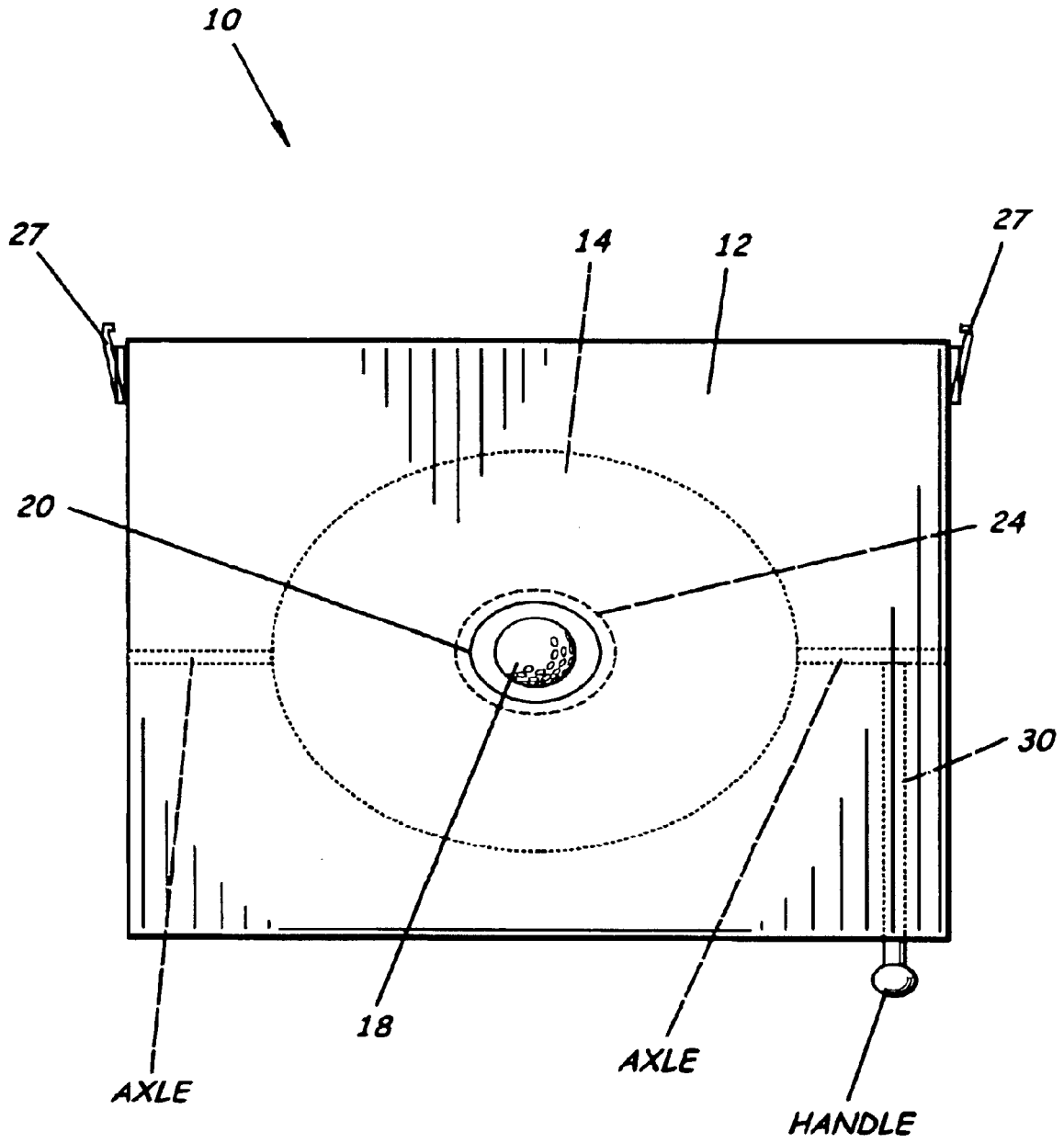
FIG. 2 shows a top plan view of the apparatus of FIG. 1.
Figure 3:
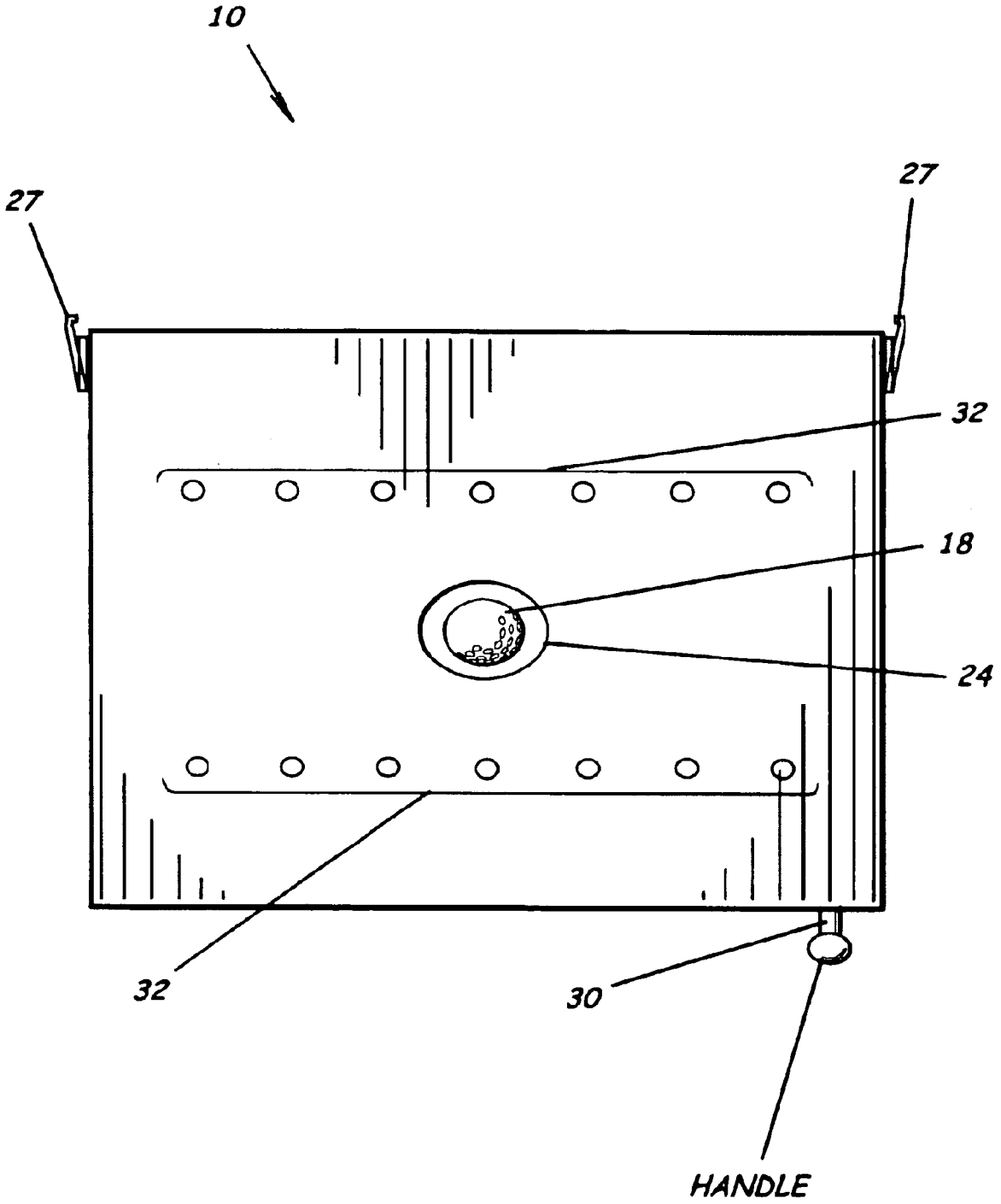
FIG. 3 shows a top plan view of another preferred embodiment of the apparatus of FIG. 1.
Figure 4:
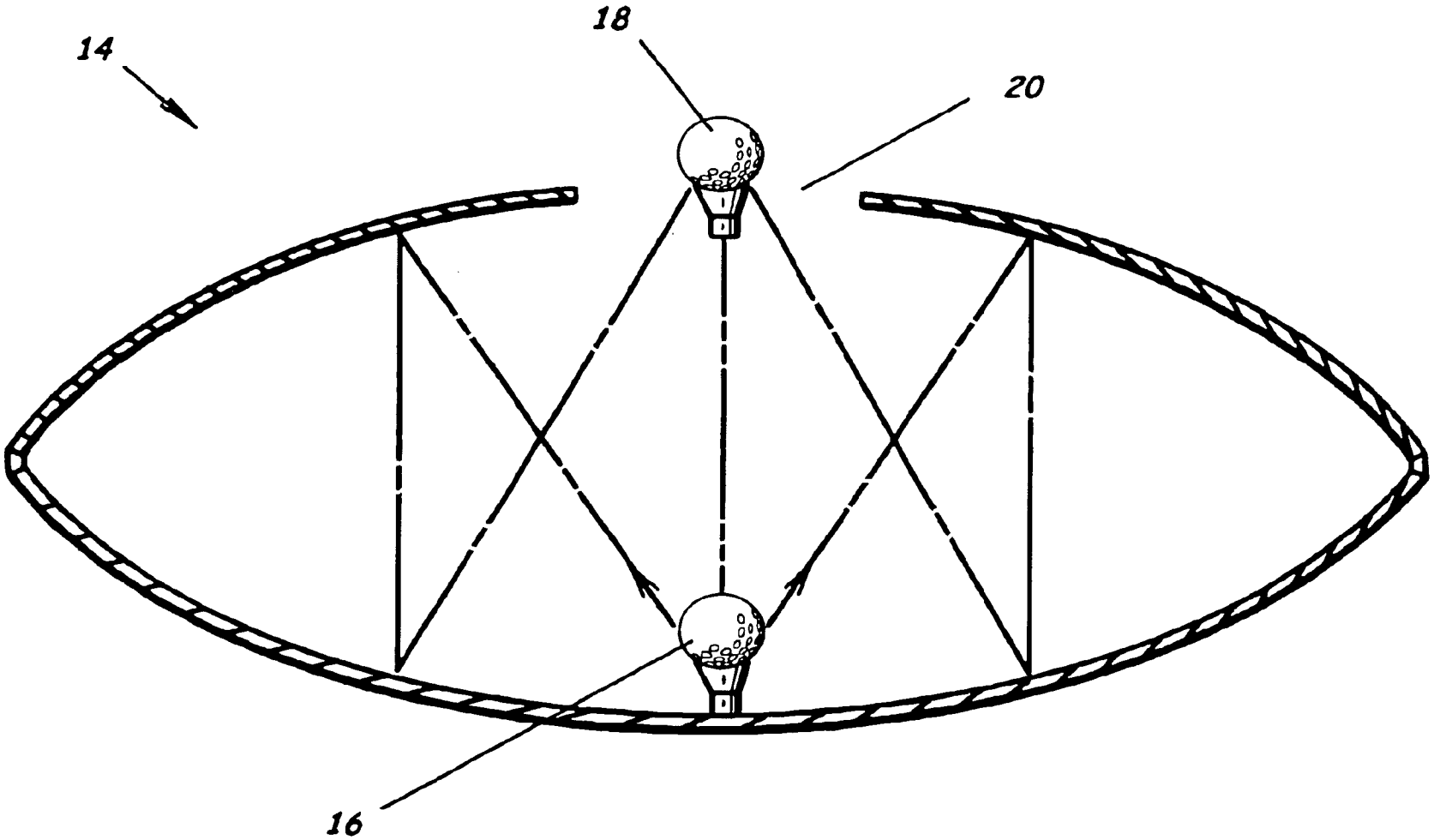
FIG. 4 is a diagrammatic cross sectional view of a curved reflector suitable for use in the present invention.

FIGS. 1 through 4 illustrate the golf swing practice apparatus 10 of the present invention. The practice apparatus comprises a playing surface 12 for a golfer to thereon practice a swing, and a reflector 14 positioned adjacent the playing surface. As shown in FIG. 4, the reflector 14 comprises a curved reflecting surface adapted for focusing a reflection of a golf ball 16 so as to produce an image 18 of the golf ball appearing adjacent the playing surface 12. The curved reflecting surface preferably comprises at least one paraboloid reflecting surface, as shown in FIG. 4. The skilled will realize, however, that the curved reflector 14 may comprise a plurality of reflecting surfaces arranged relative to each other so as to produce the desired image 18 appearing adjacent the playing surface, and that the reflector illustrated by way of non-limiting example in FIG. 4 produces a real image of the golf ball.

Figure 1:
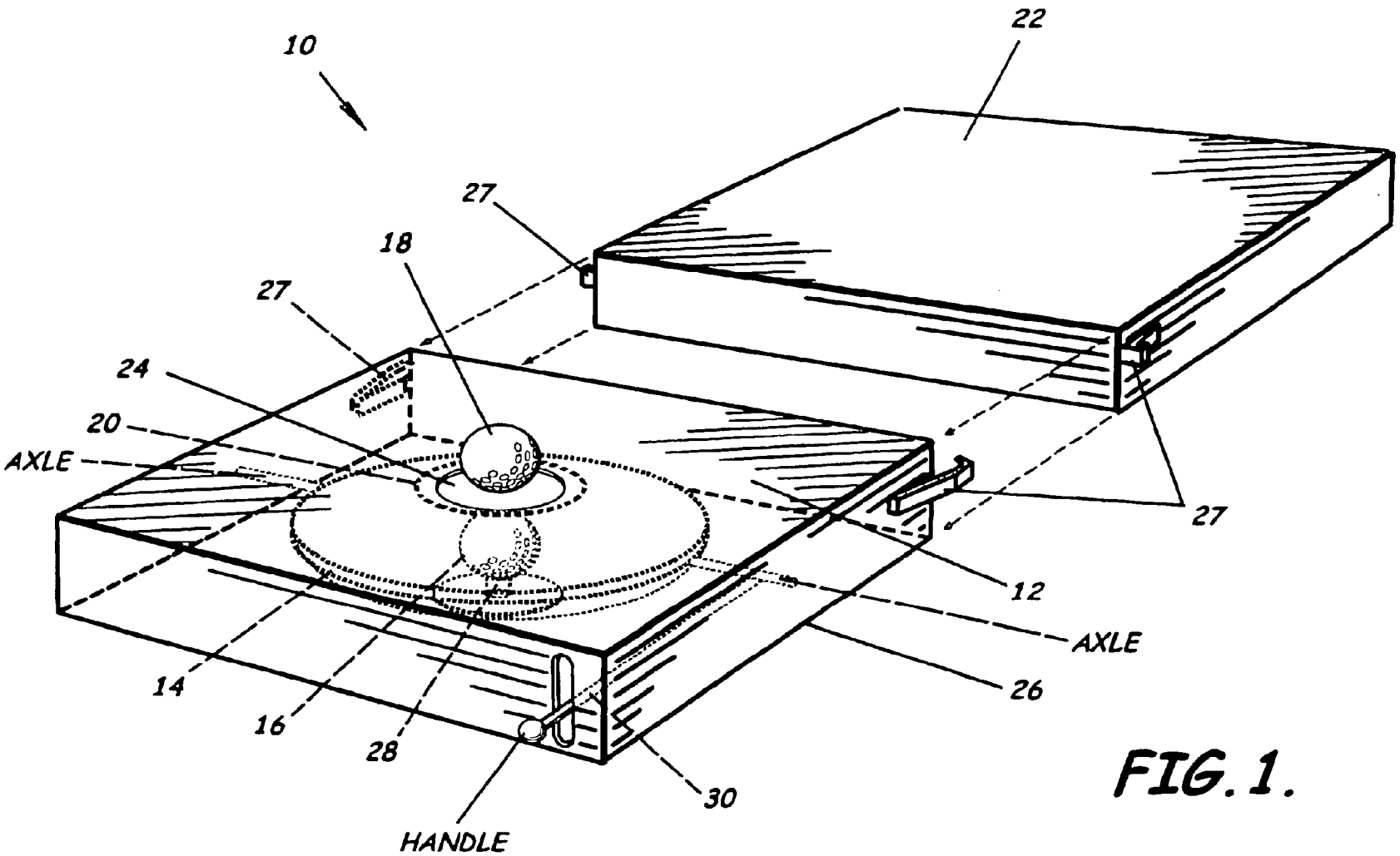
FIG. 1 is a top perspective view of the golf swing practice apparatus according to an embodiment of the present invention.

As shown in FIG. 4, the curved reflector 14 includes an opening 20 in an upper reflecting surface. The reflection of a golf ball 16 positioned within the curved reflector is focused through this opening so as to produce an image 18 appearing above the curved reflector 14, as illustrated in FIGS. 1–4. The opening 20 in reflector 14 may be covered with a clear cover (not shown) which preferably may be plastic, to thereby protect from debris the reflecting surfaces inside the reflector. This clear plastic cover may be removable to allow access to the golf ball 16 inside the reflector. The reflector 14 and playing surface 12 are positioned relative each other so that the image 18 of the golf ball appears to an observer to be adjacent the reflector and generally on the playing surface, as shown in FIGS. 1–3. The golfer may then address the image 18 of the golf ball 16 with the club head in preparation for a practice swing.

The present invention additionally comprises a standing surface 22 adjacent the playing surface 12 for a golfer to stand thereon. The standing surface 22 may be a separate component of the practice apparatus 10, as shown in FIGS. 1–3, may be a single piece with the playing surface 12, or may be a separate piece connected thereto. Additionally, the playing surface 12 of the practice apparatus 10 may advantageously be provided with a natural surface cover such as grass. Alternatively, the playing surface may comprise an artificial surface cover such as synthetic grass. As noted above, the golf swing practice apparatus 10 may additionally comprise a support supporting the playing surface. The standing surface 22 is preferably also supported by a support.

In another preferred embodiment the golf swing practice apparatus comprises a playing surface 12, a support, and a reflector 14. The playing surface has an opening 24 therethrough, as seen in FIGS. 1–3. A housing 26 acts as support for the playing surface 12, and the reflector 14 is positioned in the housing underlying the playing surface, as best shown in FIG. 1. The reflector 14 comprises a curved reflecting surface adapted for focusing a reflection of a golf ball 16 through the opening 24 in the playing surface 12 so as to produce an image 18 of the golf ball appearing adjacent the playing surface and preferably just above the opening, as illustrated in FIGS. 1–3.

Those skilled in the game of golf understand that golfers will stand at different distances from the ball in preparation for taking a swing, depending on the height of the golfer. Additionally, the angle at which the golfer views the ball will also vary according to the golfer's height, or according to the length of the golf club being used. Therefore, the present invention provides for raising or lowering the placement of a golf ball 16 within the curved reflector 14, as illustrated in FIG. 1, to allow for positional adjustment of the image 18 produced. This adjustment is preferably made by having the golf ball 16 mounted on a tee 28 which can be manually adjusted. The tee 28 may comprise a threaded member, as shown in FIG. 1, that allows raising or lowering the golf ball 16 in small increments within the reflector. It should be understood that the position where the image 18 appears is also dependent upon the exact geometry of the curved reflector 14, and it may be desirable to provide the golf swing practice apparatus having a reflector geometry especially configured for short, medium, and tall golfers. Further, as shown in FIG. 1, the invention also provides for tilting the reflector 14, which is adjustably supported on a member which may be an axle, by manipulating the handle of lever 30, allowing adjustment of the position of the image 18 particularly for use with irons, since these clubs require that the golfer stand closer to the ball for a proper swing.

In yet another preferred embodiment, the golf swing practice apparatus 10 described above further comprises a housing 26 which acts as a support for the playing surface, and wherein the reflector 14 is positioned so as to make the practice apparatus portable. The housing 26 may advantageously comprise the playing surface 12 and the standing surface 22, and may have a latch for securing both portions together in a closed position, as schematically indicated in FIG. 1. Additionally, the housing 26 is best disposed with an outer surface which comprises the playing surface 12. In an alternative embodiment, the housing 26 may be a separate component of the invention, serving to store the playing surface 12, a support (not shown), and the reflector 14. The skilled artisan will recognize that the housing 26 may also be disposed with one or more wheels and with one or more handles to facilitate portability of the apparatus. Further, the housing 26 may fold in the manner of a suitcase and may comprise a latch 27 for securing the housing in a closed position, thus providing ease of portability for the apparatus.

Other features of the invention include the playing and standing surfaces 12, 22 of the present invention being preferably constructed of a durable, lightweight material to thereby make the invention weather resistant and easily portable. For example, a preferred material for making the invention is a plastic material, although other materials may also be suitable. A two-part housing 26, as shown in FIG. 1, comprising separable standing and playing surfaces would allow for adjustment of the distance between the two, to accommodate golfers of different sizes. Alternatively, the standing and playing surfaces 22,12 could remain adjustably connected to each other, allowing for increasing or decreasing the distance therebetween. Further, the standing and playing surfaces 22,12 could display thereon lines or other indicia for aiding the golfer in aligning a proper swing.

Additional aspects of the present golf swing practice apparatus 10 include providing at least one light source (not shown) associated with the curved reflecting surface to produce an illuminated image 18 of the golf ball 16 to thereby facilitating golf swing practice in reduced light conditions. Further, the apparatus may be disposed with one or more sensors 32 responsive to the path and orientation of the club head as the golfer swings the club. An example is shown in FIG. 3, wherein sensors 32 comprising motion activated light sources such as light-emitting diodes (LEDs) are positioned along the playing surface 12. By observing the pattern of activated LEDs, the golfer may be guided to adjust an improper swing arc. The skilled will recognize that the invention includes the use of sensors 32 to monitor the golf swing, and that a sensor, or sensors, other than as shown and described by way of example, may be employed and are intended to be included within the scope of the invention. The sensors may activate both visual and audible signals responsive to a desired golf swing path. By way of further example, the sensor 32 or a sensor array may indicate a golf swing path by responsively activating a sound imitating either a properly or improperly hit golf ball.

The golf swing practice apparatus 10 of the present invention may be used as a self-standing practice device, but may also be preferably deployed in combination with a typical golf practice range having a plurality of golf swing practice stations, so that the golf swing practice apparatus comprises at least one of the plurality of golf swing practice stations. For use in a golf practice range, it may be desirable to install the practice apparatus so that its playing surface is flush with the adjacent ground, thus simulating a typical practice station. A practice station disposed with the present invention would advantageously allow a golfer to take practice swings at the image 18 of a golf ball 16, without requiring the purchase, use, and recovery of the normally necessary range balls. The present invention would thus provide an ideal warm-up practice station.

A method aspect of the present invention for practicing a golf swing includes reflecting the image of a golf ball from a curved reflecting surface to form an image of the golf ball appearing adjacent the reflecting surface, and swinging a golf club through the image of the golf ball to thereby practice the golf swing.

In the drawings and specification, there have been disclosed a typical preferred embodiments of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A golf swing practice apparatus comprising:

a playing surface for a golfer to thereon practice a swing;

a reflector positioned adjacent said playing surface, said reflector comprising a curved reflecting surface adapted for focusing a reflection of a golf ball so as to produce a real image of the golf ball appearing adjacent said playing surface, simulating a golf ball for a golfer to swing a golf club therethrough;

an axle supporting said reflector, and having a handle allowing a user rotate said axle to thereby tilt said reflector so as to move the image of the ball along an arc lying perpendicular to the playing surface; and a golf ball associated with said reflector in an adjustable manner so as to thereby change the position of the produced image up and down relative to said playing surface.

2. The golf swing practice apparatus of claim 1, wherein said curved reflecting surface further comprises a paraboloid reflecting surface.

3. The golf swing practice apparatus of claim 1, further comprising a light source associated with said reflector so as to produce an illuminated image of said golf ball.

4. The golf swing practice apparatus of claim 1, further comprising a standing surface adjacent said playing surface for a golfer to stand thereon.

5. The golf swing practice apparatus of claim 1, further comprising at least one sensor adjacent said playing surface, said at least one sensor responsive to movement of a golf club head along said playing surface.

6. The golf swing practice apparatus of claim 1, wherein said playing surface further comprises an artificial surface cover.

7. The golf swing practice apparatus of claim 1, further comprising surface indicia to guide a golfer in practicing a golf swing.

8. A golf swing practice apparatus comprising:

a playing surface for a golfer to thereon practice a swing;

a support for supporting said playing surface;

a reflector positioned adjacent said playing surface, said reflector comprising a curved reflecting surface adapted for focusing a reflection of a golf ball so as to produce an image of the golf ball appearing above said playing surface;

an axle having said reflector mounted thereon, and having a handle allowing a user rotate said axle to tilt said reflector so as to move the image of the ball along an are lying perpendicular to the playing surface; and a golf ball mounted on an adjustable stem so that the ball may be moved closer to or farther away from said reflector so as to thereby change the position of the produced image relative to said reflector.

9. The golf swing practice apparatus of claim 8 wherein said curved reflecting surface further comprises a paraboloid reflecting surface.

10. The golf swing practice apparatus of claim 8, further comprising a light source associated with said reflector so as to produce an illuminated image of said golf ball.

11. The golf swing practice apparatus of claim 8, further comprising a standing surface adjacent said playing surface for a golfer to stand thereon.

12. The golf swing practice apparatus of claim 8, further comprising at least one sensor adjacent said playing surface, said at least one sensor responsive to movement of a golf club head along said playing surface.

13. The golf swing practice apparatus of claim 8, wherein said playing surface further comprises an artificial surface cover.

14. The golf swing practice apparatus of claim 8, further comprising surface indicia to guide a golfer in practicing a golf swing.

15. A golf swing practice apparatus comprising:

a playing surface for a golfer to thereon practice a swing, said playing surface having an opening therethrough;

a support for supporting said playing surface;

a reflector positioned in said support underlying said playing surface, said reflector comprising a curved reflecting surface adapted for focusing a reflection of a golf ball through the opening in said playing surface so as to produce an image of the golf ball appearing adjacent said playing surface approximately above the opening;

a member adjustably positioned within said support and having said reflector mounted thereon, said member allowing a user to tilt said reflector so as to move the image of the ball along an arc above the playing surface; and a golf ball associated with said reflector in an adjustable manner so as to thereby change the position of the produced image closer to or father away from the reflector.

16. The golf swing practice apparatus of claim 15, wherein said curved reflecting surface further comprises a paraboloid reflecting surface.

17. The golf swing practice apparatus of claim 15, further comprising a light source associated with said reflector so as to produce an illuminated image of said golf ball.

18. The golf swing practice apparatus of claim 15, further comprising a standing surface adjacent said playing surface for a golfer to stand thereon.

19. The golf swing practice apparatus of claim 15, further comprising at least one sensor adjacent said playing surface, said at least one sensor responsive to movement of a golf club head along said playing surface.

20. The golf swing practice apparatus of claim 15, wherein said playing surface further comprises an artificial surface cover.

21. The golf swing practice apparatus of claim 15, further comprising surface indicia to guide a golfer in practicing a golf swing.

22. A golf swing practice apparatus comprising:

a playing surface for a golfer to thereon practice a swing, said playing surface having an opening therethrough;

a housing having an upper portion comprising said playing surface;

a reflector positioned in said housing underlying the opening in said playing surface, said reflector comprising a curved reflecting surface adapted for focusing a reflection of a golf ball through the opening in said laying surface so as to produce a real image of the golf ball appearing approximately above the opening for a golfer to swing a golf club therethrough;

an axle supported within the housing in an adjustable manner, having said reflector mounted thereon, and having a handle allowing a user rotate said axle to thereby tilt said reflector so as to move the image of the ball along an arc lying perpendicular to the opening in the playing surface; and a golf ball associated with said reflector in an adjustable manner so as to allow a user to move the image of the ball up or down relative to the opening in the playing surface.

23. The golf swing practice apparatus of claim 22, wherein said curved reflecting surface further comprises a paraboloid reflecting surface.

24. The golf swing practice apparatus of claim 22, further comprising a light source associated with said reflector so as to produce an illuminated image of said golf ball.

25. The golf swing practice apparatus of claim 22, further comprising at least one sensor adjacent said playing surface, said at least one sensor responsive to movement of a golf club head along said playing surface.

26. The golf swing practice apparatus of claim 22, wherein said playing surface further comprises an artificial surface cover.

27. The golf swing practice apparatus of claim 22, further comprising surface indicia to guide a golfer in practicing a golf swing.

28. The golf swing practice apparatus of claim 22, further comprising a standing surface adjacent said playing surface for a golfer to stand thereon.

29. The golf swing practice apparatus of claim 22, wherein said housing further comprises a standing surface adjustably connected thereto for a golfer to stand thereon.

30. The golf swing practice apparatus of claim 22, wherein said housing further comprises at least one handle and at least one wheel to thereby how rolling portability of the apparatus.

* * * * *